US005293415A

United States Patent [19]

Hartley et al.

[11] Patent Number: 5,293,415

[45] Date of Patent: Mar. 8, 1994

[54] X-RAY FLUOROSCOPY SYSTEM FOR REDUCING DOSAGE EMPLOYING ITERATIVE POWER RATIO ESTIMATION

[75] Inventors: Richard I. Hartley; Aiman A. Abdel-Malek; John J. Bloomer, Schenectady, all of N.Y.

[73] Assignee: General Electric Company, Schenectady, N.Y.

[21] Appl. No.: 956,203

[22] Filed: Oct. 5, 1992

[51] Int. Cl.[5] ..... H05G 1/44

[52] U.S. Cl. ..... 378/108; 378/97

[58] Field of Search ..... 378/108, 96, 97, 98, 378/109, 110, 111, 112

[56] References Cited

U.S. PATENT DOCUMENTS 5,224,141 6/1993 Yassa et al. ..... 378/99

OTHER PUBLICATIONS

U.S. Patent Application "X-Ray Dose Reduction in Pulsed Systems by Adaptive X-Ray Pulse Adjustment" RD-21,361 by Aiman A. Abdel-Malek, et al.

U.S. Patent Application "Fluoroscopic Method With Reduced X-Ray Dosage", Ser. No. 07/810,341 by Fathy F. Yassa, et al. filed Dec. 9, 1991.

"Imaging Systems for Medical Diagnostics", by Krestel, Aktiengesellschaft, Berlin and Munich, p. 103 no date.

"Medical Imaging Systems" by Macovski, 1983 Prentice-Hall, Englewood Cliffs, N.J. 07632, p. 27.

"Effect of Pulsed Progressive Fluoroscopy on Reduction of Radiation Dose in the Cardiac Catherization Laboratory", by Holmes, Wondrow, Gary, Vetter, Fellows and Julsrud, Journal. American College of Cardiology, vol. 15, No. 1, pp. 159-162 no date.

Fibonacci & Lucas numbers, an the Golden Section—Theory and Applications by S. Vadja, published by Ellis Horwood Limited, Cichester, 1989.

*Primary Examiner*—David P. Porta

*Attorney, Agent, or Firm*—Lawrence P. Zale; Marvin Snyder

[57] ABSTRACT

An interactive system for producing acceptable quality fluoroscopy images determines X-ray tube photon count and voltage while minimizing X-ray radiation dosage to a subject. Parameters of the subject and the type of image to be produced are provided to the system. X-ray tube voltage and current are initialized at a fraction of conventional values for a portion of a subject to be imaged. An image is then created and transformed. A power ratio of low frequency components to high frequency components is calculated indicating quality of the image. Images are produced and adjusted until the maximum exposure is reached, or the power ratio does not increase beyond a quality increment. The process is repeated to optimize X-ray tube voltage. The X-ray fluoroscopy procedure is performed with the optimum X-ray tube photon count and the optimum voltage thereby reducing X-ray dosage. The optimization is repeated periodically to readjust the system.

15 Claims, 7 Drawing Sheets

X-RAY FLUOROSCOPY SYSTEM FOR REDUCING DOSAGE EMPLOYING ITERATIVE POWER RATIO ESTIMATION

CROSS REFERENCES TO RELATED APPLICATIONS

This application is related to U.S. Patent application *X-Ray Dose Reduction in Pulsed Systems by Adaptive X-Ray Pulse Adjustment* Ser. No. 07/956,204 by Aiman A. Adbdel-Malek, John J. Bloomer and Steven P. Roehm assigned to the present assignee, and hereby incorporated by reference.

BACKGROUND OF THE INVENTION

1. Field of the Invention

This invention relates to fluoroscopic imaging and more specifically to reduction in patient X-ray dosage during imaging.

2. Description of Related Art

An X-ray procedure, known as fluoroscopy, creates a series of internal images of a subject. Conventional pulsed systems produce each image by transmitting an X-ray pulse or other ionizing radiation from one side of the subject and detecting the transmitted radiation or shadow at an opposite side of the subject. The intensity of an X-ray radiation beam can be described by the following equation:

$$J=\int J_0(E)e^{-\int \mu(x,E)dx}\,dE$$

from p. 103 of *Imaging Systems for Medical Diagnostics* by Erich Krestel, Siemans Aktiengesellschaft, Berlin and Munich, where E is the quantum energy of the X-ray photons, $J_0(E)$ is the intensity at energy E of an incident X-ray beam, $\mu(x,E)$ is the linear attenuation constant which changes along a direction of the ray x, and changes with photon energy E.

Different tissues exhibit different linear attenuation as a function of X-ray photon energy E, thereby exhibiting different X-ray beam intensities J after transmission through the tissue. Adjusting the X-ray photon energy, therefore, can change the relative X-ray beam intensities as they pass through different tissue types, leading to increased contrast in an image.

The difference in intensity between the incident X-ray radiation, $J_0$ and the transmitted intensity J is proportional to the dose absorbed by the subject being imaged. Compton scattering and photoelectric absorption account for the majority of the energy absorbed by the subject in the spectrum used for conventional X-ray imaging as described on p. 27 of Medical Imaging Systems by Albert Macovski, 1983 Prentice-Hall, Engelwood Cliffs, N.J. 07632.

In fluoroscopic systems, the radiation is pulsed at a rate to produce a continuous sequence of images, causing the dosage to become quite large. Fluoroscopy is commonly used in order to position a catheter or similar invasive device inside a subject. Since these procedures may take a long time, the acquired radiation accumulates to a large total dose. A primary goal of diagnostic and interventional X-ray fluoroscopic procedures is to provide an accurate diagnosis while reducing the dose received by the subject and medical staff.

Attempts have been made to reduce dose absorbed by the subject and medical staff during fluoroscopic procedures. These attempts can be classified into three categories:

(1) mechanical redesign of elements of an X-ray system such as the X-ray grid, grid cover, scintillator, table top, cassette front etc. to reduce scattering;

(2) the use of protective gear (e.g., gloves and glasses, although the use of lead gloves hampers the ability to perform the fine movements necessary for catheter placement); and (3) control of X-ray tube parameters.

The X-ray tube parameters that may be varied to reduce X-ray dosage include the following:

a) the X-ray tube voltage, which affects the photon energy of the X-rays;

b) the filament current $I_{fil}$, which affects the rate of emission of X-ray photons;

c) the pulse duration T; and d) the pulse rate.

Reduction of the filament current or the pulse duration has the effect of decreasing the exposure in each frame but at the cost of diminished image quality. The image quality is dependent on the total photon count per unit area, referred to herein as "photon count". The photon count is equal to the product of the photon rate (determined by filament current, $I_{fil}$) and the pulse duration, T.

Pulse duration T has been reduced to limit the radiation dose as described in *Effect of Pulsed Progressive Fluoroscopy on Reduction of Radiation Dose in the Cardiac Catheterization Laboratory*, by D. Holmes, M. Wondrow, J. Gray, R. Vetter, J. Fellows, and P. Julsrud, Journal American College of Cardiology, vol. 15, no. 1, pp. 159–162, January 1990 and hereby incorporated by reference.

Imaging by reduced pulse rate has the advantage of maintaining the important diagnostic signal at its original high contrast level for a given dosage, but does not collect as many frames. However, the fixed rate reduction methods produce visible jerky motion artifacts. These artifacts may also introduce time delays between a physician's actions and viewed results (e.g., moving a catheter or injecting radio-opaque dye).

A technique for imaging using reduced pulse rates triggered by the subject's organ activity was disclosed in U.S. Patent Application "Fluoroscopic Method with Reduced X-Ray Dosage" Ser. No. 07/810,341 by Fathy F. Yassa, Aiman A. Abdel-Malek, John J. Bloomer, Chukka Srinivas filed Dec. 9, 1991 assigned to the present assignee and hereby incorporated by reference. Although this technique reduces dosage by reducing the pulse rate, it does not adjust the power transmitted by the X-ray source which may further reduce dose.

Incorrectly reducing the power transmitted by the X-ray source may lead to poor quality images with reduced diagnostic content-the image may be characterized by global graininess and low contrast about important features such as the catheter, balloon, vessel boundaries, etc. Attempts to improve signal to noise ratio via noise reduction filters effect the overall image quality by averaging-out the noise contribution and result in the image being of questionable value since the diagnostic information is less exact at lower doses than at higher doses.

The X-ray tube voltage and current necessary to produce a high quality image also depend on the area of the body under study. It is well known that different tissue types attenuate X-rays differently. For example bone is quite dense, requiring high-energy X-ray photons for penetration, while fat, is quite transparent to high-energy photons. Fat requires lower-energy X-rays to retrieve an image with good definition of the embedded features (e.g., contrast).

Since conventional fluoroscopy systems may incorrectly calculate X-ray tube voltage and photon count, subjects may be exposed to more radiation than is necessary, or the images produced may be grainy and lack desired contrast.

Currently, there is a need to determine the required X-ray tube voltage and photon count accurately so as to produce a high quality image, while also minimizing the X-ray dose to the subject.

SUMMARY OF THE INVENTION

A system for X-ray fluoroscopic imaging of a subject that results in acceptable quality images with reduced radiation dosage to the subject produces images with near optimal X-ray tube photon count and voltage dynamically.

The system is initialized by specifying a maximum exposure per image $R_{max}$, a minimum acceptable signal-to-noise ratio $RATIO_{min}$ and an acceptable X-ray tube voltage range between $U_{min}$ and $U_{max}$. The goal is to determine an optimal photon count, $Q_{opt}$, and tube voltage $U_{opt}$ in the range between $U_{min}$ and $U_{max}$ such that images produced with these parameters will result in an image with signal-to-noise ratio at least as good as $RATIO_{min}$ while minimizing the exposure, R.

An initial voltage setting $U_0$ is chosen and the maximum photon count $Q_{max}$ (depending on $U_0$) is computed such that an image taken with X-ray tube voltage $U_0$ and photon count $Q_{max}$ will result in an exposure not exceeding $R_{max}$.

An initial photon count $Q_{min}$ equal to $Q_{max}$ * FRAC is chosen, where FRAC is a preset constant value, $0 < FRAC \leqq 1$, An image is produced with tube voltage $U_O$ and a chosen photon count Q in the range between $Q_{min}$ and $Q_{max}$.

The pixels of the image are transformed by a unitary transform, such as a Fourier transform to create a spectrum of frequency components. A frequency cutoff point is determined and the average power of frequency components above the cutoff frequency is identified as noise power. The average power of the whole image is identified as the sum of signal power and noise power. From this, the signal and noise power may be computed and a ratio calculated from the signal and noise components and compared with the minimum ratio $RATIO_{min}$.

Further images are produced with the same tube voltage $U_0$ and other photon counts Q in the range between $Q_{min}$ and $Q_{max}$ and the signal-to-noise ratio is computed. The smallest photon count resulting in an acceptable image is called $Q_0$. The exposure resulting from an image with photon count $Q_0$ and voltage $U_0$ is computed and denoted $R_0$.

There are several ways of choosing the sequence of photon counts Q. In one embodiment, the initial Q is chosen as the minimum photon count $Q_{min}$ and subsequent photon count settings Q are chosen in increasing increments until an acceptable image is produced. In another embodiment, a binary search between $Q_{min}$ and $Q_{max}$ is carried out to find the optimal photon count $Q_0$.

Further voltage settings $U_i$ between $U_{min}$ and $U_{max}$ are chosen and for each such voltage the corresponding optimal photon count $Q_i$ and exposure $R_i$ are determined as described above for $U_0$.

Finally, photon count $Q_{opt}$ and voltage $U_{opt}$ are chosen to be those settings $U_i$ and $Q_i$ that produce the minimum dose $R_i$.

Subsequent images for the remainder of the X-ray fluoroscopy procedure are produced using $Q_{opt}$ as the photon count and $U_{opt}$ as the X-ray tube voltage, thereby reducing the radiation dose to the subject. The optimization is repeated periodically to readjust the system.

OBJECTS OF THE INVENTION

It is an object of the present invention to minimize X-ray dose by dynamically adapting X-ray parameters used in X-ray fluoroscopic imaging.

It is another object of the invention to provide a method of non-destructive testing of materials which minimizes the amounts of received X-ray radiation.

It is another object of the invention to provide high quality images with a minimum of X-ray radiation wherein pixels of the images are transformed into a spectrum and components of the spectrum used to estimate a minimum signal-to-noise ratio.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawing in which:

DETAILED DESCRIPTION OF THE INVENTION

The X-ray dose received by a subject during the acquisition of one image is defined by:

$$D=f(U, I_{fil}, \mu)T \quad (1)$$

where U is the peak X-ray tube voltage in kilovolts, $I_{fil}$ is the X-ray tube filament current in mA, and T is the duration of the X-ray pulse in seconds. The function $f(U, I_{fil}, \mu)$ is a function depending on $\mu$, the attenuation coefficient, affected by the density and geometry of the object being irradiated, tube voltage, geometry of the X-ray system, and the image detector. The peak tube voltage determines the energy per X-ray photon. The number of photons which are emitted in a unit area is known as the photon count Q. The photon count is proportional to the duration of the pulse, T. The photon count may also be increased by increasing the filament current in a manner determined by calibration of the X-ray tube. In particular, the photon count Q is an increasing function of the X-ray tube filament current $I_{fil}$. The brightness of an image created is proportional to the total photon count Q. In order to image moving structures, the time of exposure may be reduced from seconds to a few milliseconds. Therefore, the filament current must be increased in order to produce an image of sufficient brightness.

The dose a subject receives is related to the exposure R and the amount of radiation absorbed by the subject at a given X-ray energy. With exact total attenuation and geometry unavailable, a maximum exposure $R_{max}$, which corresponds to a maximum photon count $Q_{max}$, is minimized rather than dose. The exposure is proportional to the photon count, where the constant of proportionality $\Phi(E)$ depends on the photon energy, E. In other words, $Q=R\ \Phi(E)$ where $\Phi(E)$ is a function that may be determined through lookup tables. A graph showing a suitable function $\Phi$ is given on p. 79 of Macovski supra. Pages 78 to 80 of Macovski give a discussion of the relationship between dose, exposure R and photon count Q.

The X-ray tube voltage range is based on:

(1) The object to be examined; and (2) contrast range necessary for the diagnosis (for example, an exposure of the "bony thorax" requires 66 KVp in order to diagnose the bone structure, whereas 125 KVp is required if the lung structure is to be diagnosed).

The X-ray tube voltage determines, in connection with other system parameters, the contrast of the image.

Figure 1:
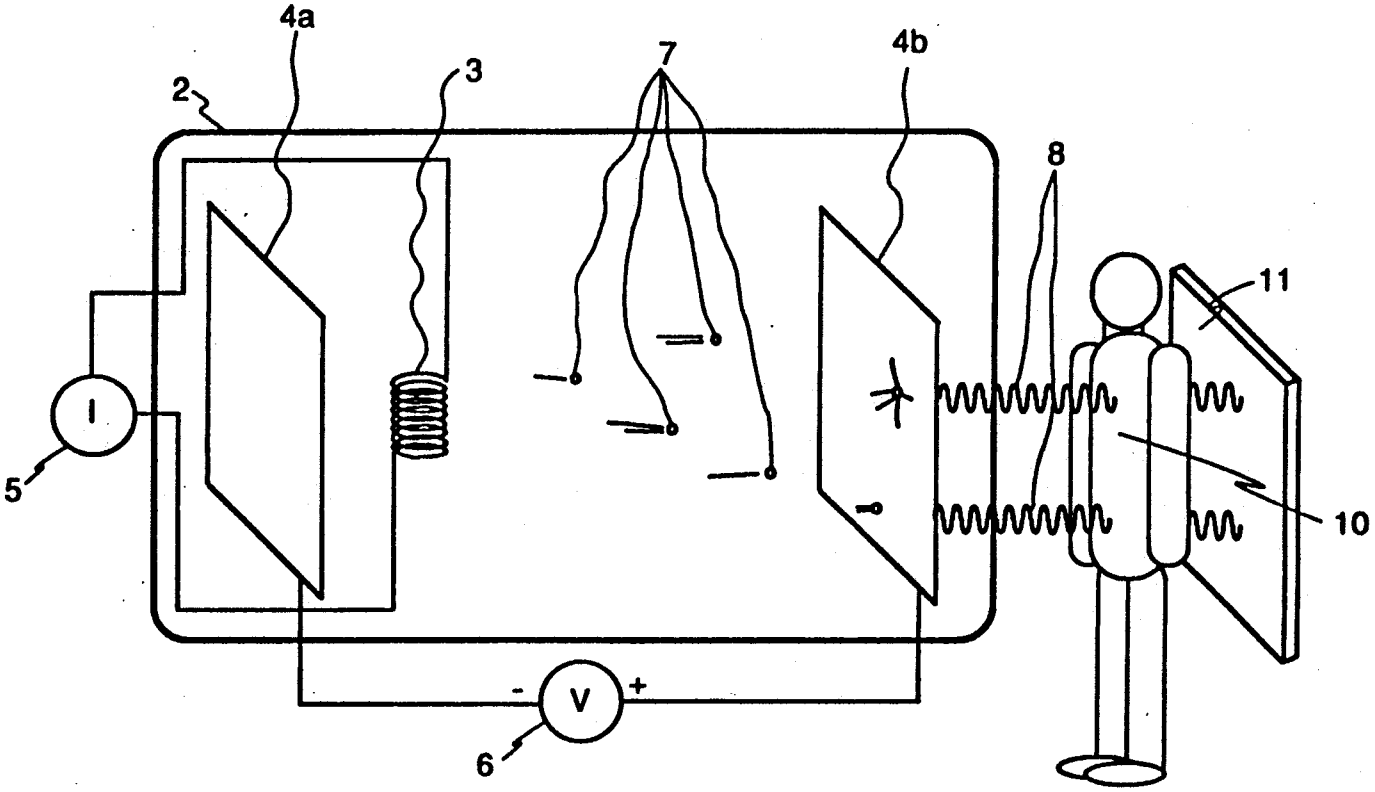
FIG. 1 PRIOR ART
FIG. 1 is a schematic diagram illustrating the operation of a conventional X-ray system.

FIG. 1 illustrates an X-ray tube comprising a coil 3 and a pair of plates 4*a* and 4*b*. A current source 5 provides the filament current which passes through coil 3, causing a number of electrons 7 to "boil-off" the coil 3. A voltage source 6 creates a voltage difference between plates 4*a* and 4*b*. Electrons 7 are repelled by negatively charged plate 4*a* to positively charged plate 4*b* and accelerate at a rate proportional to the voltage difference applied by voltage source 6. Electrons 7 collide with plate 4*b* and decelerate, causing the kinetic energy of electrons 7 to be translated into electromagnetic photons 8. The energy of each photon, (proportional to the frequency of the electromagnetic radiation), is proportional to the velocity of each electron 7 as it collides with plate 4*b*. The frequency of the electromagnetic radiation is related to its ability to penetrate material objects. The number of electrons 7 which boil off coil 3 are related to the filament current passing through coil 3. Photons 8 emitted from plate 4*b* are directed through a subject 10 to be imaged. Photons which pass through subject 10 are then recorded at a recording plane 11. Recording plane 11 may comprise photographic material which is sensitive to X-rays, or an array which is sensitive to X-rays that is used to capture an image.

The image captured at image plane 11 varies with the voltage of voltage source 6 and a filament current applied through coil 3 from current source 5, since each electron which collides with plate 4*b* creates a photon which passes through subject 10 and illuminates a small portion of image plane 11. The "graininess" of the captured image is related to the photon count Q.

The difference in attenuation of photons 8 passing through different materials of subject 10 varies with photon energy. This difference in attenuation between materials determines the degree of contrast in the created image. Therefore, the contrast of an image acquired at image plane 11 is related to the voltage applied across plates 4*a* and 4*b*.

The dose which subject 10 receives is related to the voltage applied across plates 4*a* and 4*b*, the current passing through coil 3, and the amount of time which radiation is transmitted through subject 10.

Figure 2:
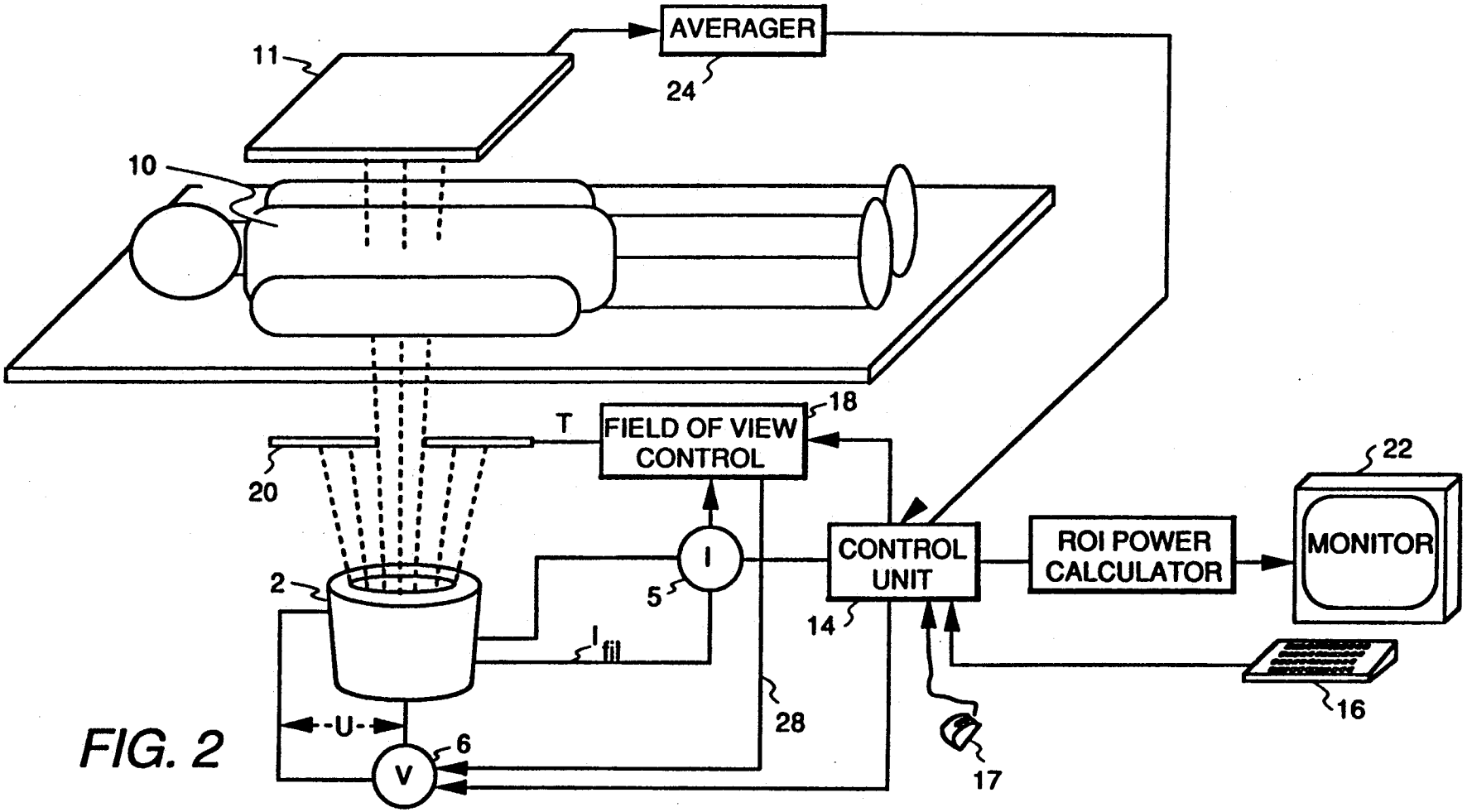
FIG. 2 is block diagram of a fluoroscopy system according to the present invention, in operation on a subject.

In the system of FIG. 2 physical information regarding the tissue or organ of a subject 10 to be imaged is provided to control unit 14 through keyboard 16. This information may include the subject's height, weight and other parameters which may effect imaging. The system may be preset with, or an operator may optionally provide a minimum acceptable power ratio $RATIO_{min}$, in the produced image. Control unit 14 establishes initial X-ray tube voltage range from $U_{min}$ to $U_{max}$ based upon conventional clinical experience tables for this purpose. Several X-ray tube voltages $U_i$ ranging from $U_{min}$ to $U_{max}$ are selected and a photon count $Q_i$ for each is determined by control unit 14 which produce at least a minimum signal-to-noise ratio $RATIO_{min}$ and does not exceed a maximum exposure $R_{max}$. The exposure $R_i$ of each is determined and the minimum exposure $R_l$, and corresponding voltage $U_l$ and photon count $Q_l$ of all selected voltages is determined. The voltage range is narrowed such that $U_{min}$ is set to $U_{l-1}$, and $U_{max}$ is set to $U_{l+1}$. If the subscript $l-1$ is less than 0, $U_0$ is used as $U_{min}$, and similarly if the subscript $l+1$ is greater than N, $U_{max}$ is set to $U_N$ by control unit 14. X-ray voltages are selected and exposures $R_i$ are determined until the difference in voltage range is not greater than a predetermined increment. At this point, $U_l$ and $Q_l$ are the best choices for producing images with a desired signal-to-noise while limiting exposure to less than $R_{max}$.

Photon count $Q_i$ corresponding to each X-ray tube voltage $U_i$ is determined by multiplying a photon count $Q_{max}$ corresponding to the maximum allowable exposure $R_{max}$ by a fraction, FRAC, such that $0<FRAC\leqq 1$, to arrive at the photon count $Q_{min}$ and a photon count Q equal to $Q_{min}$ is chosen for the first image. The photon count Q is lower than values used in conventional imaging. Control unit 14 furnishes a signal that is sent to current source 5 causing it to pass a filament current through X-ray tube 2 corresponding to the desired photon count Q. Control unit 14 also furnishes a signal to the voltage source 6 causing it to produce a voltage difference across the plates of X-ray tube 2. Control unit 14 also furnishes a signal to field of view control unit 18, causing a field of view mask 20 to be opened allowing X-rays from X-ray tube 2 to pass through subject 10 and to image plane 11. Control unit 14 can be controlled to cause current source 5 to pulse the current to control voltage source 6 to pulse the voltage across X-ray tube 2, effectively pulsing the X-ray radiation through subject 10. The signal sensed by image plane 11 is passed to an averager 24 which averages the signal over pulse time T for each point of image plane 11 and provides this signal to control unit 14. Control unit 14 constructs an image which is displayed on a monitor 22.

Control unit 14 performs a two-dimensional unitary transform transform on pixels of the image to create a spectrum. The unitary transform may be a Fourier, Discrete Cosine, Hadamard, Discrete Sine, Haar or Slant Transform as described in "Fundamentals of Digital Image Processing" by Anil K. Jain, Prentice-Hall, (1989). As described in Jain, the above-mentioned transforms are unitary if the correct scaling factor is used. If another scaling factor is used, then the transforms are no longer unitary in a strict sense, although their essential properties are unchanged. The term "unitary transformation" is used here to mean any unitary transform possibly multiplied by a scale factor. Throughout the remainder of this description, a Fourier transform is described, but the above-mentioned transforms may be used in its place.

The i,jth region, or "bin" in Fourier space is denoted as $F_{ij}$. Noise is substantially constant over the entire frequency domain, whereas the signal drops off at higher frequencies. Therefore, the noise power may be estimated by summing the power over a set of high-frequency bins in Fourier space, and a summation of the low frequency bins may be summed to estimate the signal power.

Figure 3:
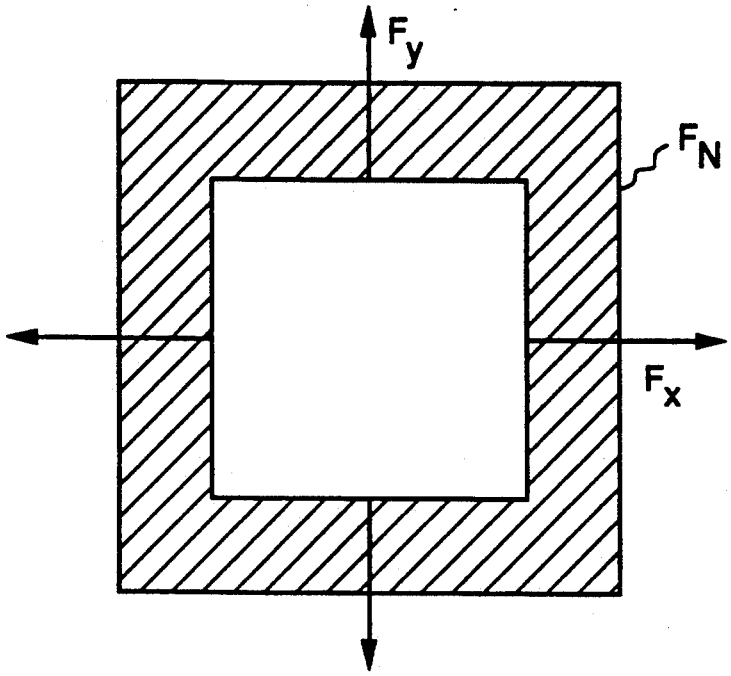
FIG. 3 is a two-dimensional Fourier space representation of a noise region in the Fourier domain.

FIG. 3 represents a two-dimensional Fourier space with the zero frequency at the center point (0,0). The shaded area represents a suitable choice of high frequency bins on which to sum the noise power. For a 256×256 or 512×512 image the width of the strip was chosen to be about 32 frequency bins although this choice of width may vary. This choice has been shown to give good results, however. Let the region be called the Fourier "noise region" and be denoted $F_N$. Let $R_N$ represent the total number of bins in the noise region. Then we can compute the average noise power per bin from the equation:

$$P_N = \left(\frac{1}{R_N}\right) \sum_{F_{ij} \in F_N} |F_{ij}|^2 \tag{2}$$

where the summation is over the region $F_N$; and the average total power per bin can be computed by:

$$P_{total} = P_S + P_N = \left(\frac{1}{C}\right) \Sigma |F_{ij}|^2 \tag{3}$$

where the summation is over all frequency bins and C is the total number of bins. The total power may also be computed from the original image, because of Parseval's equation (see Jain). It is also possible to omit the power in the zero frequency bin from the summation in (3). This results in a different definition of signal power in which so-called DC power is omitted.

An estimate of signal power is computed as the difference between formulas (3) and (2) and divided by the power of the high frequency components to result in a RATIO, indicating image quality. Control unit 14 of FIG. 2 alters the photon count Q and produces a new (i.e., second) image on monitor 22. The ratio for the second image is computed as it was for the first image. If the RATIO is less than a minimum power ratio $RATIO_{min}$ and the exposure is less than a maximum allowable exposure $R_{max}$, the photon count Q is incremented and another (i.e., third) image is created. Photon count Q is adjusted until the calculated RATIO exceeds $RATIO_{min}$, the operator intervenes, or the exposure photon count per image reaches the maximum allowable photon count $Q_{max}$. The current maximum exposure $R_{max}$ limit for the present embodiment is estimated to be a value corresponding to a patient dose less than 10 Rad per minute.

Figure 4:
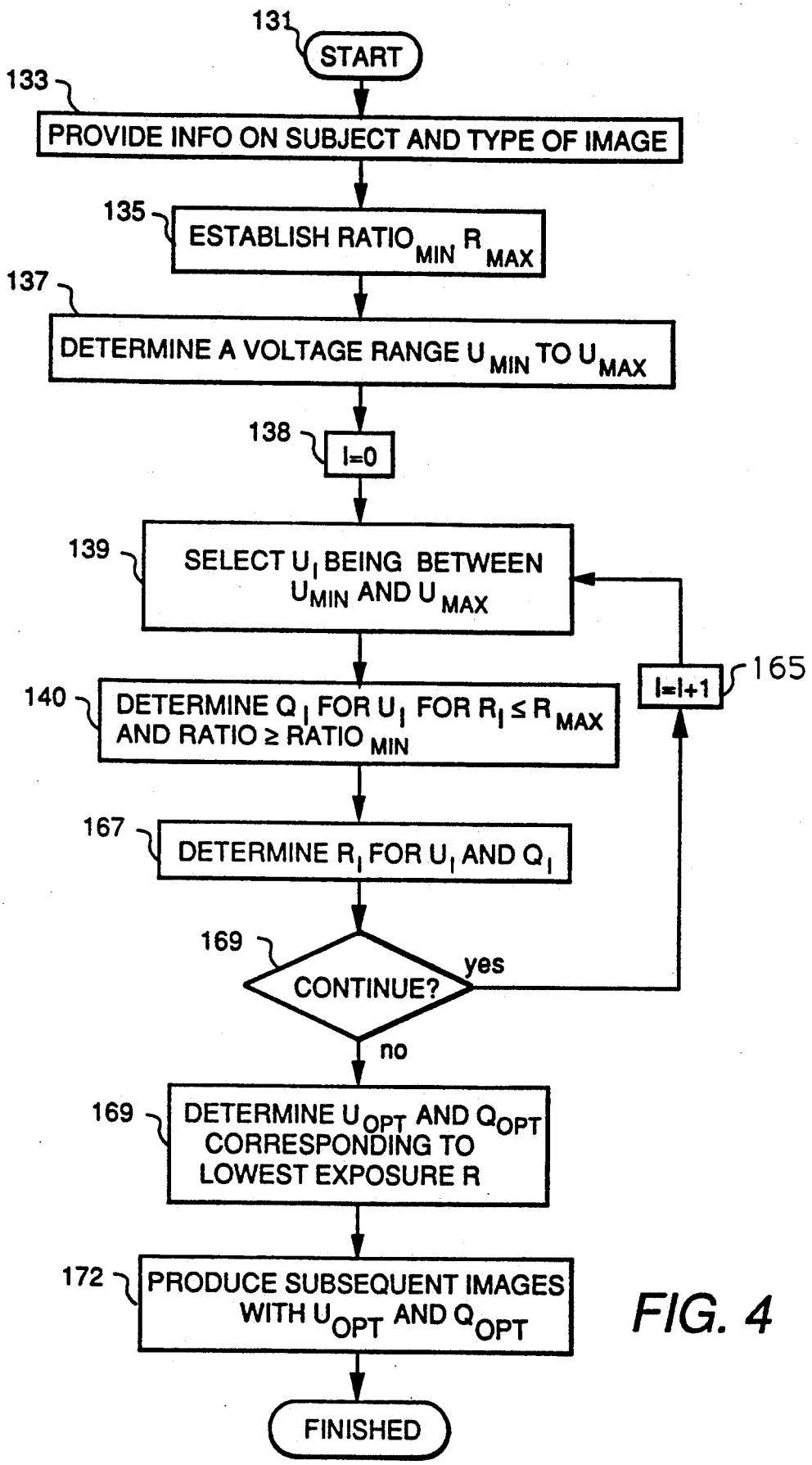
FIG. 4 is a flow chart illustrating the operation of one embodiment of the present invention.

The functioning of the present invention, and especially the control unit 14 of FIG. 2, may more specifically be described in conjunction with FIG. 4. Processing begins at step 131 of FIG. 4. At step 133, parameters regarding a portion of the subject's anatomy to be imaged and optionally, the subject's height and weight, are provided to control unit 14 of FIG. 2 with the aid of pointing device 17, keyboard 16 and monitor 22. At step 135, a minimum acceptable ratio $RATIO_{min}$ in the produced image and a maximum exposure $R_{max}$ are provided to the system.

At step 137 a voltage range from $U_{min}$ to $U_{max}$ is determined based upon the type of image to be produced and patient parameters.

At step 138 a subscript is set to a first value 0. $U_0$ is selected at step 139 being a first value in the range $U_{min}$ to $U_{max}$.

At step 140 a photon count $Q_0$ is determined which for voltage $U_0$ produces an exposure $R_0$ less than $R_{max}$ and an image with a signal-to-noise RATIO at least as great as $RATIO_{min}$. Step 140 is more specifically illustrated in FIG. 5c.

Figure 6:
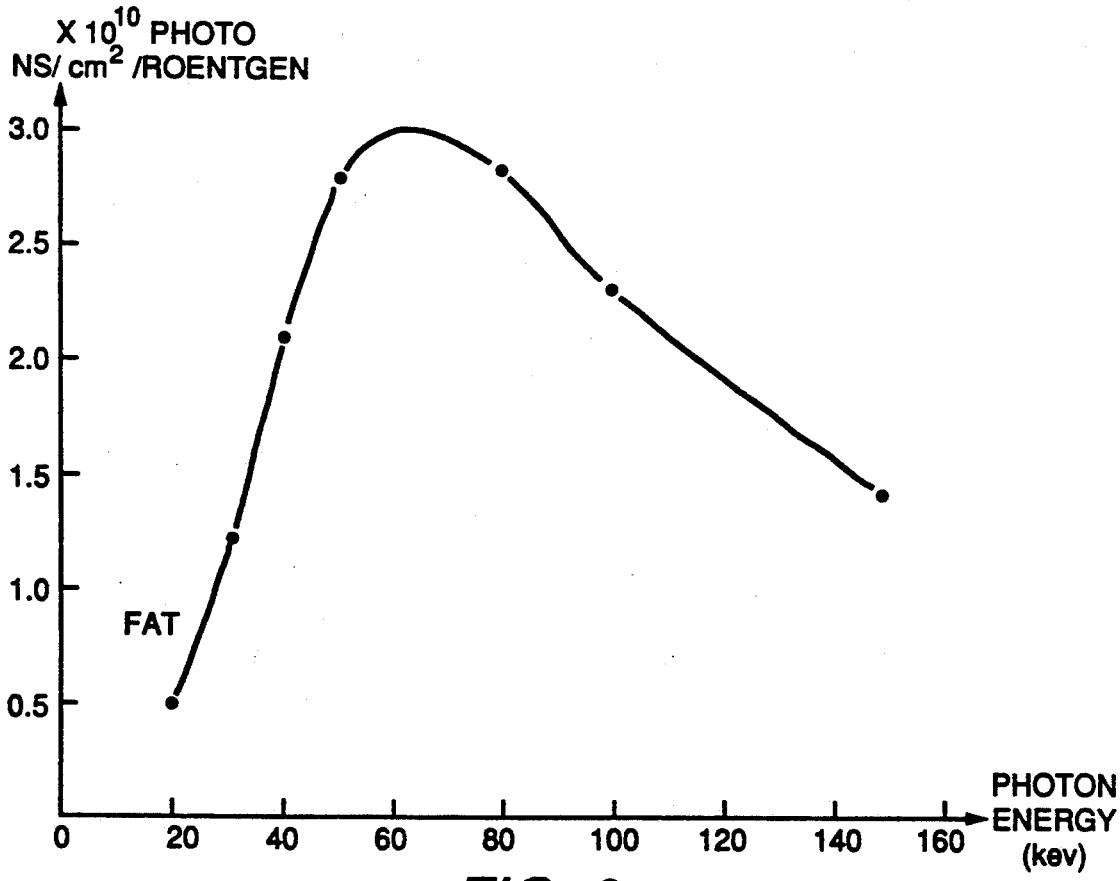
FIG. 6 is a graph of photon fluence $\Phi(E)$ as a function of energy.

At step 167 the exposure $R_0$ for $U_0$ and $Q_0$ is determined from lookup tables which equate exposure to photon count via a proportionality constant which is a function $\Phi(E)$ of X-ray photon energies E. Values of $\Phi(E)$ may be approximated from FIG. 6 from p. 79 Macovski supra.

The exposure R may be computed in terms of the X-ray tube voltage U instead of the photon energy, E, due to the known relationship between voltage U and photon energy E that may be obtained by X-ray tube calibration. In particular, for most X-ray tube designs, the average photon energy is approximately proportional to the X-ray tube voltage: E=k U where k is the constant of proportionality.

At step 169 it is determined if sufficiently many voltages have been processed, and if not, then the subscript i is incremented and processing continues at step 139.

A different X-ray tube voltage $U_1$ will be selected next between $U_{min}$ and $U_{max}$. Voltages $U_2$, $U_3$ etc. will selected in subsequent passes through the loop having a value greater than $U_{min}$ and less than $U_{max}$.

At step 171, after sufficiently many voltage entries $U_i$ have been processed, the one having the lowest exposure $R_i$ is determined. X-ray tube voltage $U_{opt}$ and photon count $Q_{opt}$ are set equal to the $U_i$ and $Q_i$ corresponding to the lowest exposure $R_i$.

In step 172, subsequent images are produced with the optimal voltage $U_{opt}$ and photon count $Q_{opt}$.

Figure 5A:
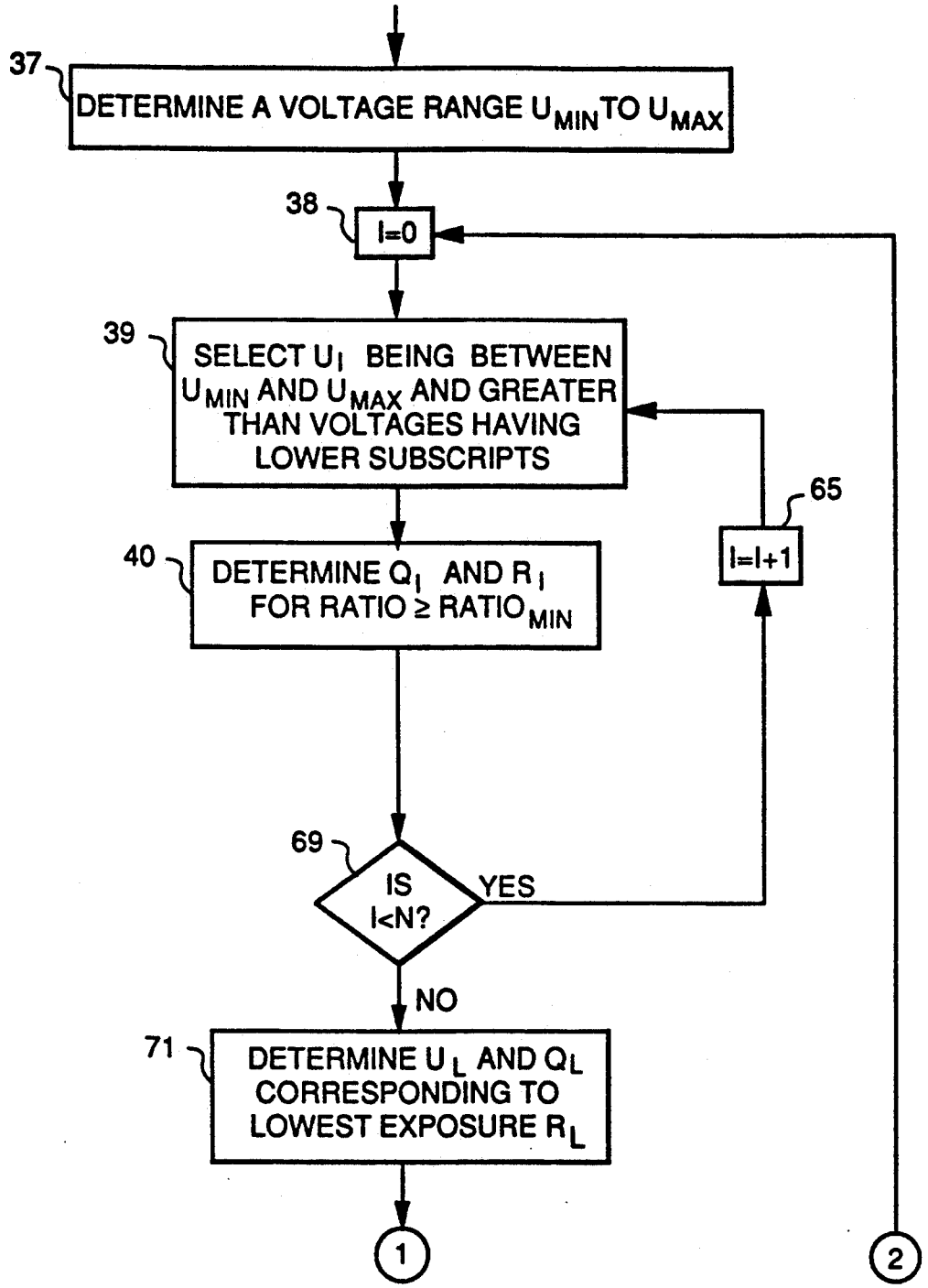
FIGS. 5*a* and 5*b* together are a partial flow chart illustrating the operation of a second embodiment of the present invention.
Figure 5B:
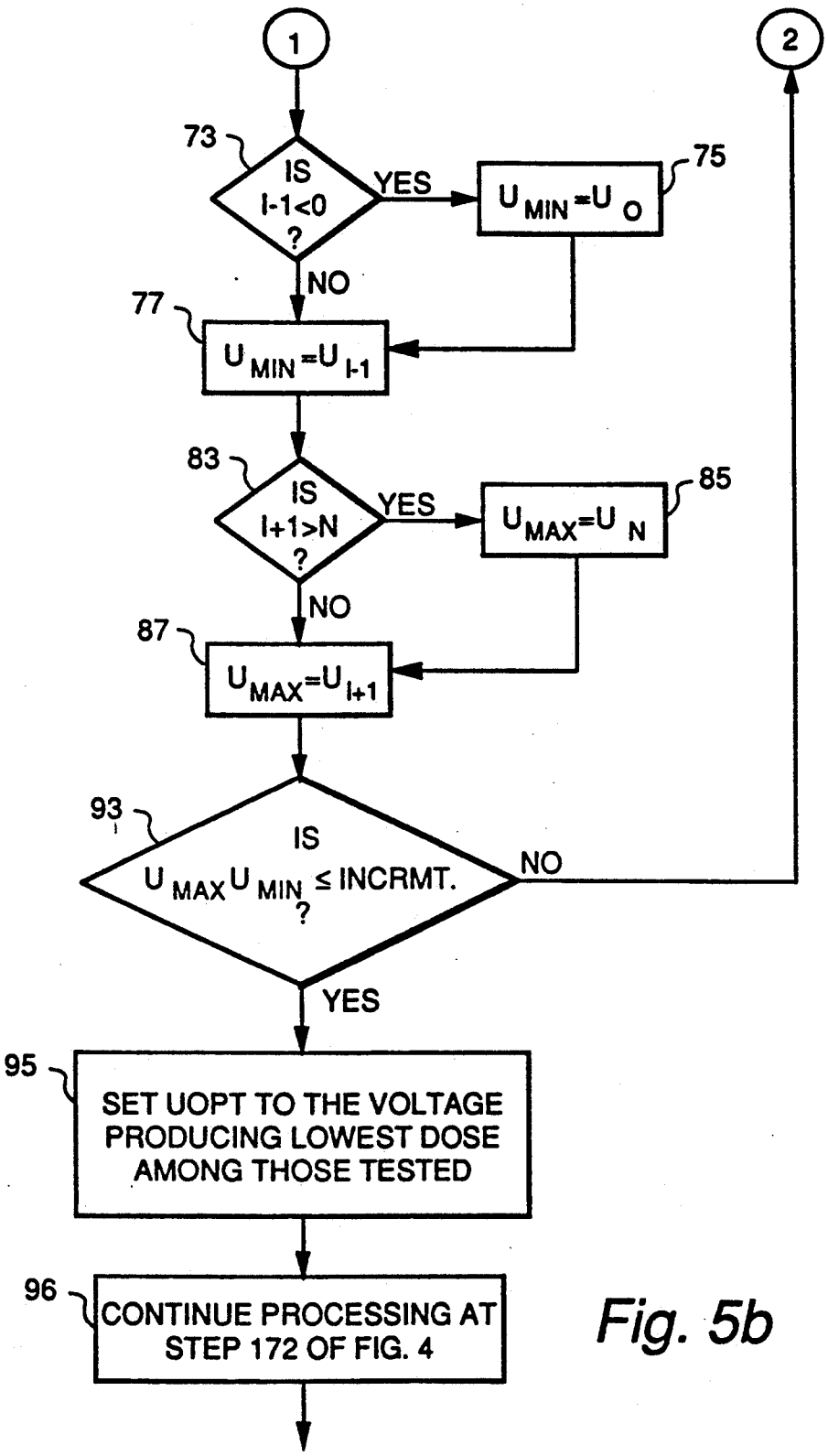

FIGS. 5a and 5b show an embodiment of the invention using one particular search strategy for the optimal voltage setting $U_{opt}$ replacing steps 137–171 of FIG. 4. The strategy uses a successively refined search for the optimal voltage.

At step 37 a voltage range from $U_{min}$ to $U_{max}$ is determined based upon the type of image to be produced and patient parameters.

At step 38 a subscript is set to a first value 0 of N+1 values. $U_0$ is selected at step 39 being a first value in the range, $U_{min}$ to $U_{max}$.

At step 40 the photon count $Q_0$ and corresponding exposure $R_0$ are determined as in steps 140 and 167 in FIG. 5.

At step 69 it is determined if all N voltages have been processed, and if not, then the subscript i is incremented and processing continues at step 39.

X-ray tube voltage $U_1$ will be selected next which will be between $U_0$ and $U_{max}$. Voltage $U_2$ will selected in the next pass through the loop having a value greater than $U_1$ and less than $U_{max}$. The last voltage, $U_N$ will be equal to $U_{max}$. Care should be taken that if the current voltage $U_i$ is one of the voltages already used in a previous stage of this method, then the optimal photon count $Q_i$ and exposure $R_i$ can immediately be set to the previously determined values.

FIGS. 5a and 5b are intended to be connected at points indicated by like numbers. At step 71, after the N voltage entries $U_i$ have been processed, the one having the lowest exposure $R_l$ is determined. X-ray tube voltage $U_l$ and photon count $Q_l$ corresponding to the lowest exposure $R_l$ is determined.

The voltage range is then reduced to the two adjacent points to $U_l$. At step 77 $U_{min}$ is set to $U_{l-1}$. This value is capped at a minimum of $U_0$ at steps 73 and 75 Similarly, at step 87, $U_{max}$ is set to $U_{l+1}$ and this values is capped to a maximum of $U_N$ at steps 83 and 85.

At step 93, if $U_{max}-U_{min}$ is not less than a predetermined voltage increment processing continues at step 38 of FIG. 5a for another set of voltage values within the newly reduced voltage range.

Otherwise at step 95 $U_{opt}$ is set to the voltage producing the lowest dose among those tested and $Q_{opt}$ is set to the corresponding photon count.

At step 96, processing continues as in step 172 of FIG. 4.

The number of increments N and the particular choice of points $U_i$ in the range $U_{min}$ to $U_{max}$ and the minimum voltage increment $\Delta U$ may be chosen in many different ways. A particular case is that in which the value of $\Delta U$ is chosen so that the sequence of steps 39 to 71 is carried out once only. Another special case is that in which $U_{min}=U_{max}$ and the voltage value is set explicity. In this case $N=1$.

Assuming that there is a single voltage for which the exposure has a local minimum, the optimal search method which makes greatest use of points (voltages) already computed is the method of Fibonacci search in which $N=3$ and the points $U_i$ are $$U_0=U_{min},$$

$$U_1=U_{min}+\tau(U_{max}-U_{min})$$

$$U_2=U_{max}+\tau(U_{min}-U_{max})$$

$$U_3=U_{max}$$

and $\tau$ is the number $(\sqrt{5}-1)/2$. The advantage of this search method is that at each iteration of steps 38 to 69 (except the first), three of the voltages $U_i$ are ones that have been considered before and corresponding values of $Q_i$ and $R_i$ have been computed, so only one new voltage value, $U_1$ or $U_2$ needs to be considered. This search method is described in chapter 10, page 115 of the book "Fibonacci & Lucas numbers, and the Golden Section—Theory and Applications" by S. Vadja, published by Ellis Horwood Limited, Chichester, 1989

Figure 5C:
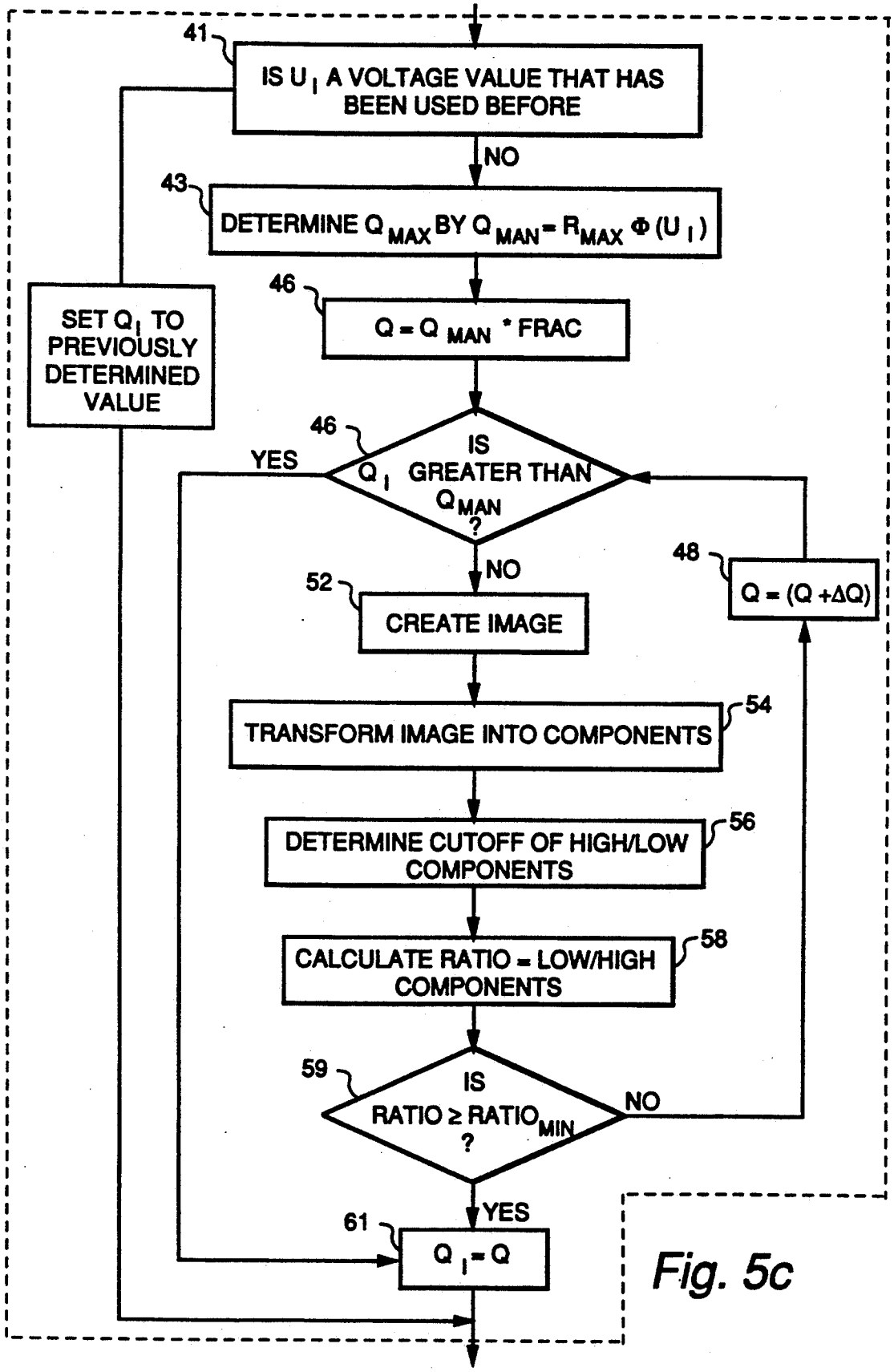
FIG. 5*c* is a more detailed flow chart of step 40 of FIG. 4.

One embodiment of step 40 of FIG. 5a is illustrated in greater detail in FIG. 5c. In particular, an incremental search for the optimal photon count $Q_i$ is shown. At step 41 it is determined if the current voltage $U_i$ has been used in a previous step with the present imaging setup. If so, then in step 42 the previously determined value of $Q_i$ is chosen. Otherwise, in step 43, the maximum permissible photon count $Q_{max}$ is determined in terms of the maximum permissible exposure $R_{max}$ using the proportionality constant relating exposure to photon count expressed by the function $\Phi(U)$ which is determined from a lookup table.

At step 44 an initial photon count Q is set to some fraction of the maximum photon count $Q_{max}$*FRAC where $0<FRAC<=1$. In this fashion the photon count Q is starting below conventional levels.

At step 46 it is determined if the photon count $Q_i$ is greater than the maximum photon count $Q_{max}$. If not, then the X-rays are transmitted through the subject at step 52, received, and an image is created, typically on monitor 22 of FIG. 2.

At step 54, control unit 14 of FIG. 2 performs a Fourier transform of the image, creating a spectrum of frequency values with the noise represented near the high-end and signal dominating the low (near DC) end of the spectrum. The spectrum is analyzed at step 56 to determine a cutoff frequency being between high frequency components and low frequency components of the spectrum.

At steps 56 and 58 RATIO is calculated as an estimation of the ratio of signal to noise components according to equations (2) and (3).

At step 59 of FIG. 5c RATIO of the present image is compared to the $RATIO_{min}$ threshold. If RATIO>$RATIO_{min}$, the image quality is acceptable and processing continues at step 61 setting $Q_i$ to Q. Processing then continues at step 67 of FIG. 5a. If it is not acceptable, the photon count Q is incremented at step 48 and processing continues at step 46 of FIG. 5c.

While FIG. 4 shows an incremental search for the best photon count value $Q_i$, other search methods are possible. In particular, since the signal-to-noise ratio RATIO will be an increasing function of photon count Q, a binary search for the best photon count value $Q_i$ between the values $Q_{min}$ and $Q_{max}$ may be substituted in the place of an incremental search.

Once the optimal X-ray tube voltage has been determined, the adaptation process may be repeated as required. The adaptation process may be restarted periodically under the control of the control unit 14 of FIG. 2. In the present embodiment, the readjustment process is repeated every several seconds. By adjusting $RATIO_{min}$ and $R_{max}$ through the keyboard 16, pointing device 17 and monitor 22 of FIG. 2, the operator has interactive control over the final image quality.

The resulting images will have acceptable quality and will be produced while minimizing the X-ray dosage to the subject.

While several presently preferred embodiments of the invention have been described in detail herein, many modifications and variations will now become apparent to those skilled in the art. It is, therefore, to be understood that the appended claims are intended to cover all such modifications and variations as fall within the true spirit of the invention.

What is claimed is:

1. A method of reduced dose X-ray imaging of a subject comprising the steps of:

a) selecting a minimum acceptable signal-to-noise ratio, $RATIO_{min}$ and maximum exposure per image, $R_{max}$;

b) selecting an X-ray tube voltage $U_i$ within an acceptable X-ray tube voltage range;

c) determining a photon count $Q_i$ corresponding to the X-ray tube voltage U being less than a maximum allowable photon count $Q_{max}$ consistent with limiting the subject's exposure to an acceptable level $R_{max}$ and for creating an image having a signal-to-noise ratio at least as great as $RATIO_{min}$;

d) transmitting X-ray radiation through said subject by applying the X-ray tube voltage $U_i$, and a current corresponding to photon count $Q_i$ to an X-ray tube;

e) sensing the X-ray radiation which was transmitted through said subject;

f) constructing an X-ray image of said subject from the sensed X-ray radiation;

g) determining an exposure R per image;

h) repeating steps "b"-"g" for several selected X-ray tube voltages $U_i$;

i) setting $U_{opt}$ and $Q_{opt}$ to one of the selected X-ray tube voltages $U_i$ and corresponding photon count $Q_i$ respectively, which produce a minimum exposure $R_i$ to said subject while creating an image with a signal-to-noise ratio greater than $RATIO_{min}$; and j) producing subsequent X-ray images with $U_{opt}$ and $Q_{opt}$.

2. The method of reduced dose X-ray imaging of a subject as recited in claim 1 wherein the step of determining a photon count $Q_i$ comprise the binary search method as follows:

a) selecting a photon count increment $\Delta Q$;

b) determining a maximum photon count $Q_{max}$ in terms of the maximum allowable exposure $R_{max}$ and the current tube voltage $U_i$ and setting a photon count $Q_{high}$ to $Q_{max}$;

c) setting $Q_{low}$ to a value below a photon count required for imaging;

d) if $Q_{high}-Q_{low}$ is less than $\Delta Q$, then continuing processing at step "k";

e) setting a photon count $Q_{mid}$ to $(Q_{high}+Q_{low})/2$;

f) creating an image with an X-ray tube voltage U and a photon count $Q_{mid}$;

g) estimating a signal-to-noise ratio, RATIO, from the created image; and h) if RATIO is less than $RATIO_{min}$ then setting $Q_{low}$ to $Q_{mid}$ and continue processing at step "d";

j) if RATIO is greater than $RATIO_{min}$ then setting $Q_{high}$ to $Q_{mid}$ and continue processing at step "d"; and k) setting $Q_i$ to $Q_{high}$.

3. The method of reduced dose X-ray imaging of a subject as recited in claim 1 wherein the step of determining a photon count $Q_i$ corresponding to each X-ray tube voltage $U_i$ comprising the steps of:

a) Determining a maximum photon count $Q_{max}$ in terms of the maximum allowable exposure $R_{max}$ and the current tube voltage $U_i$;

b) setting a photon count Q to a fraction, FRAC multiplied by $Q_{max}$ where FRAC is a fraction less than 1.

c) if the photon count Q exceeds the maximum photon count $Q_{max}$, then continuing at step "g";

d) creating an image with X-ray tube voltage $U_i$ and photon count Q;

e) estimating a signal-to-noise ratio, RATIO, from the created image; and f) if RATIO is less than $RATIO_{min}$ then incrmenting Q and repeating steps "c"-"e" for subsequent images; and g) setting $Q_i$ to Q.

4. The method of reduced dose X-ray imaging of a subject as recited in claim 3 wherein the step of estimating a signal-to-noise ratio, RATIO, comprising the steps of:

a) performing a unitary transformation on pixels of the image to arrive at a transform components;

b) estimating a total power in the image by the formula $$P_{total} = P_S + P_N = \left(\frac{1}{C}\right)\Sigma|F_{ij}|^2$$

where C is the total number of bins in the transform domain and the sum is over all bins in the transform domain, or all except the zero-frequency bin.

c) estimating a noise power in the image by summing the power in a region of frequency bins known as the noise region $F_N$ made up of a set of high frequency bins, using the formula $$P_N = \left(\frac{1}{R_N}\right)\sum_{F_{ij}\epsilon F_N}|F_{ij}|^2$$

d) Calculating an image quality estimate RATIO according to the formula:

$$RATIO=(P_{total}-P_N)/P_N.$$

5. The method of reduced dose X-ray imaging of a subject as recited in claim 4 wherein the step of performing a unitary transformation comprising the steps of performing a Fourier Transformation on pixels of the image.

6. The method of reduced dose X-ray imaging of a subject as recited in claim 4 wherein the step of performing a unitary transformation comprising the steps of performing a Discrete Cosine Transformation on pixels of the image.

7. The method of reduced dose X-ray imaging of a subject as recited in claim 4 wherein the step of performing a unitary transformation comprising the steps of performing a Hadamard Transformation on pixels of the image.

8. The method of reduced dose X-ray imaging of a subject as recited in claim 4 wherein the step of performing a unitary transformation comprising the steps of performing a Haar Transformation on pixels of the image.

9. The method of reduced dose X-ray imaging of a subject as recited in claim 4 wherein the step of performing a unitary transformation comprising the steps of performing a Discrete Sine Transformation on pixels of the image.

10. The method of reduced dose X-ray imaging of a subject as recited in claim 4 wherein the step of performing a unitary transformation comprising the steps of performing a Slant Transformation on pixels of the image.

11. A method of reduced dose X-ray imaging of a subject comprising the steps of:

a) selecting a minimum acceptable signal-to-noise ratio, $RATIO_{min}$ and maximum exposure per image, $R_{max}$;

b) selecting an X-ray tube voltage range from $U_{min}$ to $U_{max}$;

c) selecting a plurality of N X-ray tube voltages $U_i$ where (i=0,1,2,3 . . . N) with increasing subscripts indicating increasing voltage values and each being from $U_{min}$ to $U_{max}$;

d) determining a photon count $Q_i$ corresponding to each X-ray tube voltage $U_i$ being less than a maximum allowable photon count $Q_{max}$ consistent with limiting the subject's exposure to an acceptable level $R_{max}$ and for creating an image having a signal-to-noise ratio at least as great as $RATIO_{min}$;

e) transmitting X-ray radiation through said subject by applying the X-ray tube voltage $U_i$, and a current corresponding to photon count $Q_i$ to an X-ray tube;

f) sensing the X-ray radiation which was transmitted through said subject;

g) constructing an X-ray image of said subject from the sensed X-ray radiation:

h) determining an exposure $R_i$ per image for each voltage $U_i$ and its corresponding photon count $Q_i$;

i) determining the X-ray tube voltage $U_l$ and corresponding photon count $Q_l$ of the selected values which exhibits a minimum exposure to a subject;

j) setting $U_{min}$ to $U_{l-1}$ unless $l-1<0$ then setting $U_{min}$ to $U_0$;

k) setting $U_{max}$ to $U_{l+1}$ unless $l+1>N$ then setting $U_{max}$ to $U_N$;

l) if the difference between $U_{max}$ and $U_{min}$ is not less than a predetermined increment, then repeating steps "c"–"h" for the new range $U_{min}$ to $U_{max}$;

m) setting $U_{opt}$ to $U_l$ and setting $Q_{opt}$ to $Q_l$; and n) producing subsequent images with selected X-ray tube voltage $U_{opt}$ and the corresponding photon count $Q_{opt}$.

12. The method of reduced dose X-ray imaging of a subject as recited in claim 11 wherein the step of determining a photon count $Q_i$ corresponding to each X-ray tube voltage $U_i$ comprising the steps of:

a) determining a maximum photon count $Q_{max}$ in terms of the maximum allowable exposure $R_{max}$ and the current tube voltage $U_i$;

b) setting a photon count Q to a fraction, FRAC multiplied by $Q_{max}$ where FRAC is a fraction less than 1;

c) if the photon count Q exceeds the maximum photon count $Q_{max}$, then continuing at step "g";

d) creating an image with X-ray tube voltage $U_i$ and photon count Q;

e) estimating a signal-to-noise ratio, RATIO, from the created image; and f) if RATIO is less than $RATIO_{min}$ then incrementing Q and repeating steps "c"–"e" for subsequent images; and g) setting $Q_i$ to Q.

13. The method of reduced dose X-ray imaging as recited in claim 1 wherein the minimum acceptable signal-to-noise ratio, $RATIO_{min}$, and the X-ray tube voltage range are set manually by an operator.

14. The method of reduced dose X-ray imaging as recited in claim 1 wherein the maximum allowable exposure $R_{max}$ is obtained from conventional lookup tables.

15. The method of reduced dose X-ray imaging as recited in claim 10 wherein N=3 and the X-ray tube voltages $U_0$, $U_1$, $U_2$ and $U_3$ are chosen in the range $U_{min}$ to $U_{max}$ in order to implement a Fibonacci search algorithm.

* * * * *